US012559279B2

(12) United States Patent
Xiao et al.

(10) Patent No.: US 12,559,279 B2
(45) Date of Patent: Feb. 24, 2026

(54) PLASTIC BAG PACKAGING AND SEPARATING DEVICE FOR INTELLIGENT PACKAGING TOILET

(71) Applicants: Jiangsu Sanjo Intelligent Technology Co., Ltd., Jiangsu (CN); Photon Robot (Ningbo) Co., Ltd., Zhejiang (CN)

(72) Inventors: Heping Xiao, Jiangsu (CN); Lei Wang, Jiangsu (CN); Jiang Zhang, Jiangsu (CN)

(73) Assignees: Jiangsu Sanjo Intelligent Technology Co., Ltd., Jiangsu (CN); Photon Robot (Ningbo) Co., Ltd., Zhejiang (CN)

( * ) Notice: Subject to any disclaimer, the term of this patent is extended or adjusted under 35 U.S.C. 154(b) by 0 days.

(21) Appl. No.: 18/827,896

(22) Filed: Sep. 9, 2024

(65) Prior Publication Data

US 2025/0083851 A1 Mar. 13, 2025

(30) Foreign Application Priority Data

Sep. 8, 2023 (CN) ..... 202311155471.5

(51) Int. Cl.
*B65B 51/16* (2006.01)
*B65B 51/02* (2006.01)

(52) U.S. Cl.
CPC ..... *B65B 51/16* (2013.01); *B65B 51/02* (2013.01)

(58) Field of Classification Search
CPC ..... B65B 51/16; B65B 51/02; B65B 51/10; A47K 11/04
See application file for complete search history.

(56) References Cited

U.S. PATENT DOCUMENTS 3,648,302 A * 3/1972 Winters ..... A47K 11/026 4/484
3,908,336 A * 9/1975 Forslund ..... B65B 9/15 53/548
4,519,104 A * 5/1985 Nilsson ..... A47K 11/026 4/484
6,052,842 A * 4/2000 He ..... A47K 11/026 4/484

(Continued)

FOREIGN PATENT DOCUMENTS

CN 216071515 U * 3/2022 ..... B65B 51/10
JP 2016037307 A * 3/2016 ..... A47K 11/04

*Primary Examiner* — Anna K Kinsaul
*Assistant Examiner* — Nicholas E Igbokwe
(74) *Attorney, Agent, or Firm* — JCIPRNET

(57) ABSTRACT

A plastic bag packaging and separating device for an intelligent packaging toilet includes a synchronous belt, a driving shaft, a motor, guide rods, a gathering mechanism, roller assemblies, a hot melting base, and a hot melting device, and further includes a silica gel strip container, an exhaust sheet, and a lower rotating mechanism. The motor is connected to the driving shaft. The synchronous belt is wound around the driving shaft. The gathering mechanism is engaged with the synchronous belt through an engaging member and is slidably arranged on the guide rods. The hot melting device is mounted on the hot melting base. The lower rotating mechanism is connected to the hot melting base. The roller assemblies are respectively arranged below the guide rods. The silica gel strip container is arranged on the gathering mechanism. The exhaust sheet is arranged below the silica gel strip container.

3 Claims, 4 Drawing Sheets

(56) References Cited

U.S. PATENT DOCUMENTS

| | | | | |
|---|---|---|---|---|
| 2009/0165196 | A1* | 7/2009 | Mochizuki | A47K 11/026 4/315 |
| 2009/0255045 | A1* | 10/2009 | Sakurai | A47K 11/026 4/484 |
| 2013/0125301 | A1* | 5/2013 | Natt | A47K 11/026 4/484 |
| 2016/0347491 | A1* | 12/2016 | Shimanuki | B65F 1/062 |
| 2019/0142231 | A1* | 5/2019 | Nelson | A47K 11/026 4/483 |

* cited by examiner

PLASTIC BAG PACKAGING AND SEPARATING DEVICE FOR INTELLIGENT PACKAGING TOILET

CROSS-REFERENCE TO RELATED APPLICATION

This application claims the priority benefit of China application serial no. 202311155471.5, filed on Sep. 8, 2023. The entirety of the above-mentioned patent application is hereby incorporated by reference herein and made a part of this specification.

TECHNICAL FIELD

The present disclosure relates to the technical field of intelligent toilets, and particularly to a plastic bag packaging and separating device for an intelligent packaging toilet.

DESCRIPTION OF RELATED ART

Technical Background

At present, most of intelligent toilets on the market are flush toilets equipped with additional sensors and some small devices to offer users a more comfortable experience in terms of temperature and cleaning. However, the way of cleaning via flushing has great limitations for some specific occasions and people. Flush toilets have some disadvantages in terms of portability, convenience, and hygiene because they need to be connected to the water supply and drainage system. To improve the convenience and portability of the toilet, methods commonly used on the market include cleaning the container of excrement and placing a plastic bag in the container for packaging. However, both the two methods require a complicated process and are unhygienic. Some toilets adopt an automatic packaging method to solve the inconvenience of manual cleaning or bag changing. Such devices make use of the movement of the packaging mechanism to simultaneously realize the packaging and changing of plastic bags, making the cleaning and carrying of the toilets more convenient and hygienic, and also making the toilets applicable to more scenarios and more people. However, the packaging mechanisms of most existing intelligent toilets also has some disadvantages, such as poor packaging and sealing effect and incomplete separation of plastic bags after packaging. As a result, the plastic bag is not easy to clean, and the used plastic bag is still connected to unused plastic bags, and therefore is likely to break when taken out, resulting in excrement leakage.

SUMMARY OF THE INVENTION

To solve the problems of poor packaging and sealing effect and incomplete separation of plastic bags after packaging in the packaging mechanisms of the intelligent packaging toilets on the market, the present disclosure provides a plastic bag packaging and separating device for an intelligent packaging toilet. The technical solution of the present disclosure is implemented as follows.

A plastic bag packaging and separating device for an intelligent packaging toilet is provided, including a synchronous belt, a driving shaft, a motor, guide rods, a gathering mechanism, roller assemblies, a hot melting base, and a hot melting device, and further including a silica gel strip container, an exhaust sheet, and a lower rotating mechanism, where the motor is connected to the driving shaft, the synchronous belt is wound around the driving shaft, the gathering mechanism is engaged with the synchronous belt through an engaging member and is slidably arranged on the guide rods, the hot melting device is mounted on the hot melting base, the lower rotating mechanism is connected to the hot melting base, the roller assemblies are respectively arranged below the guide rods, the silica gel strip container is arranged on the gathering mechanism, and the exhaust sheet is arranged below the silica gel strip container.

Preferably, the lower rotating mechanism includes a housing, a rotating shaft motor, and a rotating shaft; and the rotating shaft motor is mounted on the housing, and the rotating shaft is connected to the rotating shaft motor.

Preferably, the lower rotating mechanism further includes horizontal slots, and the horizontal slots are provided on the housing.

Preferably, a rubber sleeve is sleeved over the rotating shaft.

Preferably, silica gel strips are attached in the silica gel strip container, the gathering mechanism is provided with a mounting hole, and the silica gel strip container is connected to the gathering mechanism through the mounting hole.

In the present disclosure, the lower rotating mechanism is arranged on the hot melting base and the silica gel strips are arranged on the gathering mechanism. As such, by using the friction between the rotating shaft and the silica gel strips, a rotation of the rotating shaft drives the plastic bag to rotate, so as to tighten the plastic bag to facilitate the separation of the plastic bag.

DESCRIPTION OF THE DRAWINGS

In order to more clearly explain the technical solutions in the embodiments of the present disclosure or in the prior art, the drawings used in the description of the embodiments or the prior art will be briefly described below. Obviously, the drawings depicted below are merely an embodiment of the present disclosure, and those skilled in the art can obtain other drawings based on these drawings without any creative efforts.

Like parts and components are denoted by like reference numerals. It should be noted that the terms such as "front", "rear", "left", "right", "upper", and "lower" used in the following description refer to directions in the drawings, and the terms such as "bottom surface", "top surface", "inner", and "outer" respectively refer to directions toward or away from the geometric center of a particular component.

Figure 1:
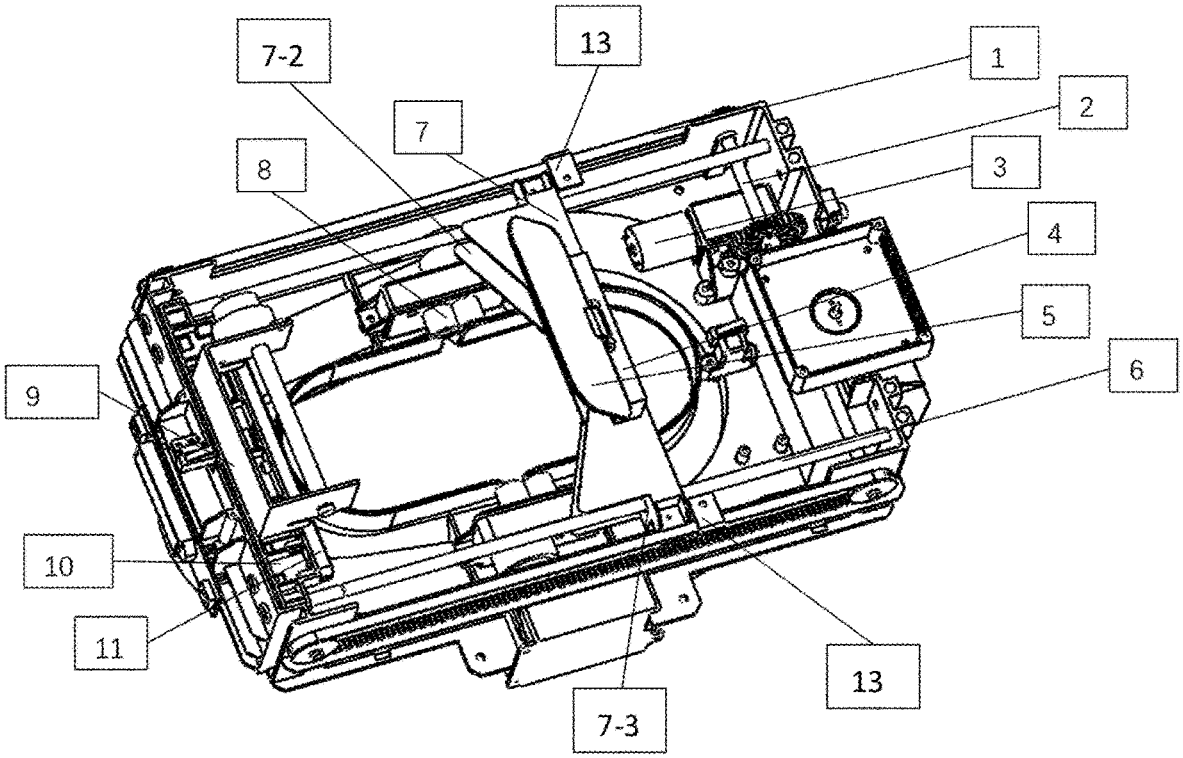
FIG. 1 is a schematic structural diagram of an embodiment of a plastic bag packaging and separating device for an intelligent packaging toilet.

In the drawings, the reference numerals respectively represent:

1. synchronous belt;
2. driving shaft;
3. motor;
4. silica gel strip container;
5. exhaust sheet;
5-1. exhaust rotating shaft;

6. guide rod;
7. gathering mechanism;
7-1. mounting hole; 7-2. triangular wing piece; 7-3 sliding portion;
8. roller assembly;
9. lower rotating mechanism;
9-1. housing; 9-2. rotating shaft motor; 9-3. rotating shaft; 9-4. horizontal slot; 9-5. motor mounting hole; 9-6. threaded hole;
10. hot melting base;
11. hot melting device;
12. silica gel strip;
13. engaging member.

DETAILED DESCRIPTION OF THE EMBODIMENTS

The technical solutions in the embodiments of the present disclosure will be described clearly and fully with reference to the accompanying drawings in the embodiments of the present disclosure. Apparently, the embodiments described are merely some embodiments, rather than all of the embodiments of the present disclosure. All other embodiments obtained by a person of ordinary skill in the art without creative efforts based on the embodiments of the present disclosure shall fall within the protection scope of the present disclosure.

Embodiment 1

In a specific embodiment, as shown in FIG. 1, a plastic bag packaging and separating device for an intelligent packaging toilet includes a synchronous belt 1, a driving shaft 2, a motor 3, a silica gel strip container 4, an exhaust sheet 5, guide rods 6, a gathering mechanism 7, roller assemblies 8, a lower rotating mechanism 9, a hot melting base 10, and a hot melting device 11. The motor 3 is connected to the driving shaft 2. The synchronous belt 1 is wound around the driving shaft 2. The gathering mechanism 7 is engaged with the synchronous belt 1 through an engaging member 13 and is slidably arranged on the guide rods 6 through a sliding portion 7-3 of the gathering mechanism 7. The hot melting device 11 is mounted on the hot melting base 10. The lower rotating mechanism 9 is connected to the hot melting base 10. The roller assemblies 8 are respectively arranged below the guide rods 6. The silica gel strip container 4 is arranged on the gathering mechanism 7. The exhaust sheet 5 is arranged below the silica gel strip container 4.

Figure 2:
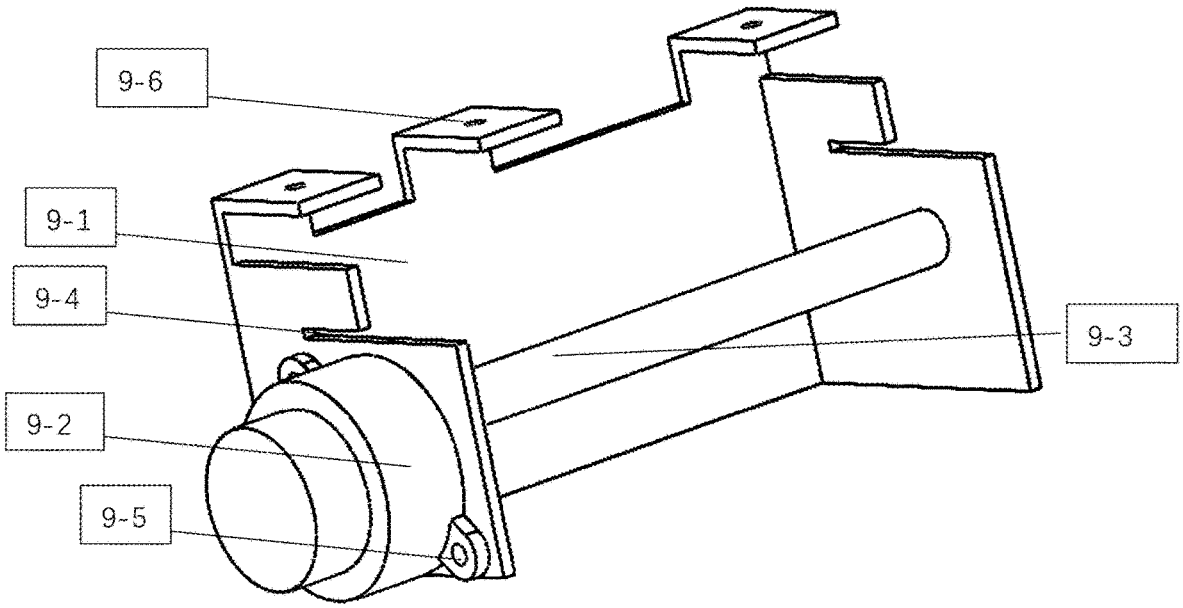
FIG. 2 is a structural diagram of an embodiment of a lower rotating mechanism.

As shown in FIG. 2, the lower rotating mechanism 9 includes a housing 9-1, a rotating shaft motor 9-2, a rotating shaft 9-3, horizontal slots 9-4, a motor mounting hole 9-5, and a threaded hole 9-6. The rotating shaft motor 9-2 is mounted on the housing 9-1 through the motor mounting hole 9-5. The rotating shaft 9-3 is connected to the rotating shaft motor 9-2. The horizontal slots 9-4 are provided on the housing 9-1. A rubber sleeve is sleeved over the rotating shaft 9-3. The threaded hole 9-6 is provided on the housing 9-1.

Figure 3:
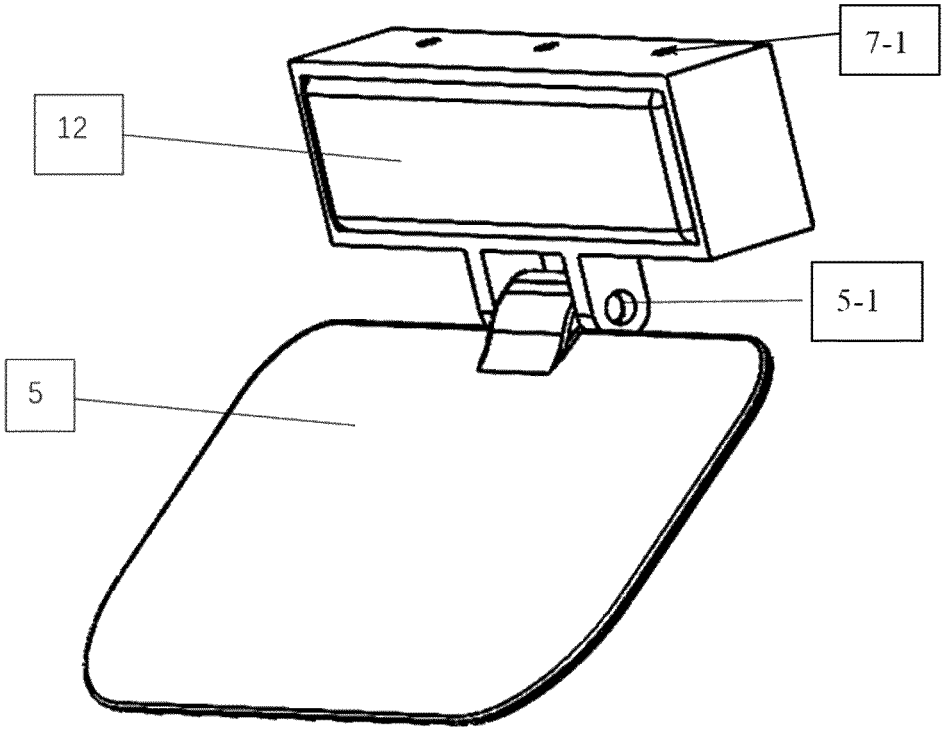
FIG. 3 is a schematic structural diagram of an embodiment of a silica gel strip container.

As shown in FIG. 3, silica gel strips 12 are attached in the silica gel strip container 4, the gathering mechanism 7 is provided with a mounting hole 7-1, and the silica gel strip container 4 is connected to the gathering mechanism 7 through the mounting hole 7-1.

In this embodiment, the driving shaft 2 is driven to rotate by the motor 3, and a belt wheel is arranged on the driving shaft 2. The belt wheel rotates to cause the synchronous belt 1 to rotate. The gathering mechanism 7 is engaged with the synchronous belt 1 through the engaging member 13. The gathering mechanism 7 slides on the two parallel guide rods 6 along with the rotation of the synchronous belt 1, to close a mouth of a plastic bag for packaging by hot melting. The hot melting base 10 is mounted on a left side of a toilet seat. The hot melting device 11 is mounted in front of the hot melting base 10. The lower rotating mechanism 9 is mounted on the hot melting base 10. The rotating shaft 9-3 and the rotating shaft motor 9-2 are mounted on the lower rotating mechanism 9. Two roller assemblies 8 are respectively arranged on two sides below the toilet seat for pulling down the plastic bag. The silica gel strip container 4 and the silica gel strips 12 matching the lower rotating mechanism 9 are provided on the gathering mechanism 7. The exhaust sheet 5 is arranged below the silica gel strip container 4. During gathering, the exhaust sheet 5 is in a vertical state and slowly squeezes air out of the plastic bag in a cavity of a toilet bowl. As such, the utilization of space in the toilet bowl in the lower part of the intelligent packaging toilet can be improved. After the gathering mechanism 7 gathers the plastic bag to a position for sealing by hot melting on the left side, the rotating shaft motor 9-2 on the lower rotating mechanism 9 drives the rotating shaft 9-3 to rotate. Because the plastic bag is pressed between the rotating shaft 9-3 and the silica gel strips 12, one side of the plastic bag is pulled downward by a friction force of the rotating shaft 9-3, and the other side of the plastic bag is pulled by a friction force between rollers in each of the roller assemblies 8, so that the plastic bag is tightened, to facilitate the cutting and separation of the plastic bag. After the hot melting is completed, the gathering mechanism 7 does not return immediately to the original position, but instead, moves back to a position between the hot melting position and the original position and then stops. In this case, the rotating shaft 9-3 is rotated again to further rotate the used plastic bag downward, to ensure that the used plastic bag is completely separated from an unused plastic bag.

The motor 3 of the lower rotating mechanism 9 is fixed to a left side of the housing 9-1 by a fastening bolt through the threaded hole 9-6 on the housing 9-1. In addition, to prevent the housing 9-1 from interfering with a triangular wing piece 7-2 of the gathering mechanism 7, a horizontal slot 9-4 is formed on each of the left side and the right side of the housing 9-1. The housing 9-1 is directly fixed to the hot melting base 10 through a hole on the housing 9-1 by bolt connection. The rotating shaft 9-3 is directly connected to an output shaft of the motor 3, and is connected to the motor 3 through a flat key in the middle of the shaft. The other end of the rotating shaft 9-3 passes through a circular hole on the right side of the housing 9-1, and a circlip is mounted on the shaft to achieve the axial positioning. A rubber material is sleeved over an outer surface of the rotating shaft 9-3 to increase the friction between the rotating shaft 9-3 and the plastic bag.

Figure 4:
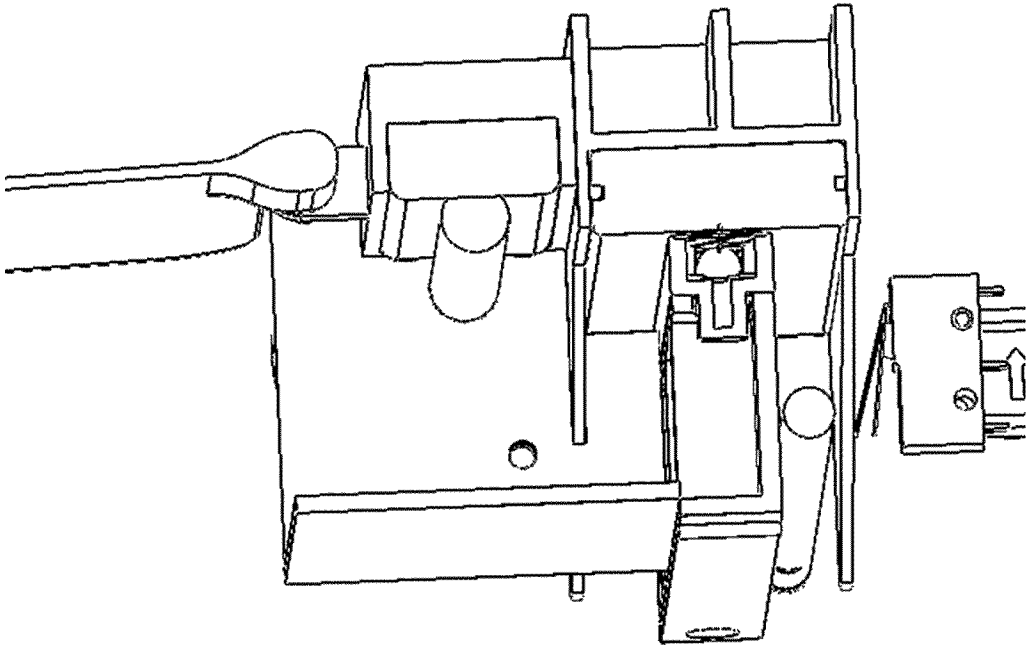
FIG. 4 is a diagram showing a usage state of an embodiment of a plastic bag packaging and separating device for an intelligent packaging toilet.

The silica gel strip container 4 is connected through the mounting hole 7-1 on the gathering mechanism 7 by bolt connection. The silica gel strips 12 are attached in the silica gel strip container 4 by back adhesive, and are mainly configured to cooperate with the rotating shaft 9-3 to tightly press the plastic bag, and provide a buffering effect to reduce noise. The exhaust sheet 5 is fitted to slot holes at a lower part of the gathering mechanism 7 through an exhaust rotating shaft 5-1. A limiting mechanism is arranged at a rear structure of the slot hole, so that the exhaust sheet 5 is limited to be rotated to a maximum of 90 degrees (i.e., a vertical state) relative to the gathering mechanism 7, as shown in FIG. 4. As such, during the pushing of the gathering mechanism 7, the exhaust sheet 5 can remove air from the region it passes through.

The operation effect during working of the packaging mechanism is shown in FIG. 4. When the plastic bag is driven by the belt wheel to move to the hot melting sealing mechanism, the gathering mechanism 7 touches a micro switch, a heating sheet, and the rotating shaft 9-3 below at the same time. The plastic bag is tightly pressed on upper and lower silica gel strips 12 of the gathering mechanism 7 at the same time. In this case, the rotating shaft 9-3 is rotated to drive the pressed plastic bag to move downward, to tighten the part of the plastic bag between the roller assemblies 8 and the rotating shaft 9-3, and then the heating sheet starts to heat to a suitable temperature for hot melting. After the hot melting is completed, the gathering mechanism 7 moves back to a position between the hot melting position and the original position, in which case the rotating shaft 9-3 is rotated again to pull downward the plastic bag that has been cut after hot melting, to ensure the separation of the plastic bag. Then, the gathering mechanism 7 returns to the original position. Thus, one working cycle is completed.

It should be noted that the foregoing descriptions are merely some embodiments of the present disclosure, but are not to limit the present disclosure. Any modification, equivalent replacement, and improvement made within the spirit and principle of the present disclosure shall fall within the protection scope of the present disclosure.

What is claimed is:

1. A plastic bag packaging and separating device for an intelligent packaging toilet, comprising a synchronous belt, a driving shaft, a motor, guide rods, a gathering mechanism, roller assemblies, a hot melting base, and a hot melting device, further comprising a silica gel strip container, an exhaust sheet, and a lower rotating mechanism;

wherein, the motor is connected to the driving shaft, the synchronous belt is wound around the driving shaft, the gathering mechanism comprises a triangular wing piece, and is engaged with the synchronous belt through an engaging member and is slidably arranged on the guide rods through a sliding portion of the gathering mechanism, the hot melting device is mounted on the hot melting base, the lower rotating mechanism is connected to the hot melting base, the roller assemblies are respectively arranged below the guide rods, the silica gel strip container is arranged on the gathering mechanism, and the exhaust sheet is arranged below the silica gel strip container, the lower rotating mechanism comprises a housing, a rotating shaft motor, and a rotating shaft; the rotating shaft motor is mounted on the housing, the rotating shaft is connected to the rotating shaft motor.

2. The plastic bag packaging and separating device for the intelligent packaging toilet according to claim 1, wherein the lower rotating mechanism further comprises horizontal slots, the horizontal slots are provided on the housing.

3. The plastic bag packaging and separating device for the intelligent packaging toilet according to claim 1, wherein silica gel strips are attached in the silica gel strip container, the gathering mechanism is provided with a mounting hole, the silica gel strip container is connected to the gathering mechanism through the mounting hole.

* * * * *